US010861425B1

(12) United States Patent
D'Addario et al.

(10) Patent No.: US 10,861,425 B1
(45) Date of Patent: Dec. 8, 2020

(54) RAPID CONNECT SNARE ASSEMBLY

(71) Applicant: D'Addario & Company, Inc., Farmingdale, NY (US)

(72) Inventors: James D'Addario, Old Westbury, NY (US); Richard Ned Steinberger, Nobleboro, ME (US); Richard Stillwell, Melville, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 16/449,565

(22) Filed: Jun. 24, 2019

(51) Int. Cl.
*G10D 13/02* (2020.01)
*G10D 13/18* (2020.01)

(52) U.S. Cl.
CPC ..... *G10D 13/02* (2013.01); *G10D 13/18* (2020.02)

(58) Field of Classification Search
CPC ..... G10D 13/02; G10D 13/18
USPC ..... 84/415
See application file for complete search history.

(56) References Cited

U.S. PATENT DOCUMENTS 4,018,130 A 4/1977 Gariepy, Sr.
5,507,214 A 4/1996 Hoshino
6,020,547 A 2/2000 Chen
6,093,877 A 7/2000 Nickel
7,728,211 B1 * 6/2010 Gatzen ..... G10D 13/02 84/415
2004/0011185 A1 1/2004 Ishimatsu
2005/0204895 A1 9/2005 Yu-Hwa
2016/0042725 A1 2/2016 Huang
2017/0132993 A1 5/2017 Belli et al.

* cited by examiner

*Primary Examiner* — Jianchun Qin
(74) *Attorney, Agent, or Firm* — Alix, Yale & Ristas, LLP

(57) ABSTRACT

A snare system for use with a drum has a snare assembly with snares extended longitudinally between opposite end plates. The end plates define a slot from a top surface to a bottom surface with obliquely extending walls. Two connectors, each with a strap carrying a latch member, are attached to opposite sides of the drum via its strap with latch member within the drum rim. Each latch member includes a flange with oblique configuration complimentary to the oblique slot in the end plates. The snare assembly is attached via sliding engagement of the respective flanges into the respective slots with the surfaces of each in surface-to-surface contact so that the connectors maintain the snare assembly attached to the drum. The snare assembly is removable quickly by reverse sliding of the flanges from the slots to interchange with a different snare assembly having end plates with a common configuration.

20 Claims, 12 Drawing Sheets

RAPID CONNECT SNARE ASSEMBLY

BACKGROUND

The disclosure relates to snare drums, and more particularly to an assembly for mounting snare wires to the drum shell in contact with the drumhead that can be rapidly connected and disconnected.

A snare drum is a common drum and a central drum to a drum set that is distinctive both in function and design. A basic characteristic of a snare drum is in the design of the upper and lower bearing rims or edges of the drum shell, across which the drumhead is stretched and vibrates. The upper bearing edge of the snare drum is typically shaped evenly (flat) around the 360-degree circumference while the bottom bearing edge includes two cutouts positioned parallel to each other and 180 degrees apart. The cutout is called the "snare bed" and varies in length and depth depending the model and/or the manufacturer.

The snare wires are a set of wires, often coiled, varying in material (although most are steel), coil pitch, wire quantity, gauge, shape, length, spacing between wires, and overall width. Wires can be formed from non-metal materials, such as gut or nylon as well. These variables control the amount and timbre of the "snare" sound as the drumhead and wires vibrate during play. The ends of each set of individual snare wires are typically fit or otherwise attached to two opposite plates, often referred to as the "end plate" or "end-clip" which are situated within the bearing edge adjacent a respective cut out. Each end plate is attached to a strap or cable which runs through the snare bed and along the outside of the shell. One strap is attached to a snare strainer and the other strap is attached to a butt end. The butt end holds one strap in fixed anchored position relative to the edge while the strainer can selectively pull or release the other strap thereby changing the tension on the snare wires.

These general characteristics of snare drums are known widely in the musical field, and for example, are described in detail in co-owned U.S. Pat. No. 7,728,211, the entire content of which is hereby incorporated by reference.

Most drummers own a variety of snare units or assemblies with different types of wires, each of which has distinctive sound qualities. Each snare unit as purchased typically includes the snare wires connected on each longitudinal end to an end plate with corresponding two straps, one for attachment to the butt end and one for attachment to the strainer. Known snare mounting assemblies and techniques carry drawbacks, including difficulties in attachment and optional detachment of the snares to the drum. Attaching snare assemblies via straps to the strainer and/or butt end can be cumbersome and time consuming, and often requires tools like a screwdriver or drum key to release and tightening to a preferred tension. Thus, it is quite onerous to remove the snares from the drum once attached. Additionally, many known snare assemblies carry a drawback in that tightening of the straps tilts the end plate in a direction that actually pulls the snares upward away from the drumhead at the edges, which can cause vibrational issues such as extraneous buzzing.

Thus, it would be useful to provide a snare assembly that is suitable for rapid attachment and detachment of snares to a drum and which reduces or eliminates the phenomenon of snares being pulled from the drumhead edges.

SUMMARY

The present disclosure is directed to several aspects of the invention, which are preferably but not necessarily combined. The inventive snare system achieves numerous benefits, including without limitation: extremely quick changing of snare wires without hardware, and leveraging snare wires into contact with the drumhead at the outer edges.

In a first embodiment, a snare system includes a snare assembly and a connector. The snare assembly has a plurality of snares that extend longitudinally between opposite ends. One end of the snare wires is attached to an end plate that has a body that defines a slot between two longitudinally opposed flat surfaces. The connector includes a strap that carries a latch member. The strap extends longitudinally from an outer edge of the latch member and is configured to attach to the drum at an outer portion of the drum. The latch member includes a flange configured for sliding receipt within the slot of the end plate. The slot and the flange are angled obliquely relative to the longitudinal direction such that the latch member abuts both of the opposed flat surfaces in a surface-to-surface configuration when slidingly received within the slot.

The system may include a second end plate on the second end of the snares that is substantially identical to the first end plate, and a second connector with a latch member substantially identical to the first latch member that is attached to the drum on a diametrically opposite side, with the second latch member engaged within the slot of the second end plate.

The slot may include a wide section and a narrow section. The narrow section may extend through an outward edge of the end plate to form an opening.

In another embodiment of the snare system, a snare assembly has a plurality of elongate snares extending substantially parallel to one another longitudinally between opposing end plates. Each of the end plates comprises a body with a slot that extends obliquely relative to the longitudinal direction. The system includes a pair of connectors with each connector of the pair being attached to the drum at an outer portion at approximately diametrically opposite sides. Each of the connectors includes a latch member with an obliquely extending flange that is sized and shaped to be received by the obliquely extending slot in one of the end plates. The snare assembly is connected to the drum with the snares extending diametrically across and in contact with a lower membrane of the drum via engagement of the flange of one connector with the slot of one end plate and engagement of the flange of the other connector with the slot of the other end plate.

In yet another embodiment of the snare system, a snare assembly has a plurality of elongate snares extending substantially parallel to one another longitudinally between opposing ends. One end of the snares is attached to a first end plate with a substantially flat top surface and a bottom surface, and an inner edge and an opposite outer edge. The end plate further defines a slot extending between the top and bottom surfaces. A first connector has a strap extending from an outer edge of a latch member with the strap connectable to a side of a drum. The latch member includes a flange slidably receivable within the slot of the end plate. The slot includes a longitudinally forward surface and a longitudinally rearward surface and each slot surface extends obliquely downward relative to the flat top surface is engaged by an opposite surface of the flange in a surface-to-surface engagement, which rigidly secures the latch member to the end plate when the flange is received within the slot.

BRIEF DESCRIPTION OF THE DRAWINGS

Embodiments will be described in greater detail with reference to the accompanying drawings, in which.

DETAILED DESCRIPTION

Among the benefits and improvements disclosed herein, other objects and advantages of the disclosed embodiments will become apparent from the following wherein like numerals represent like parts throughout the several figures. Detailed embodiments of a rapid connect snare assembly are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
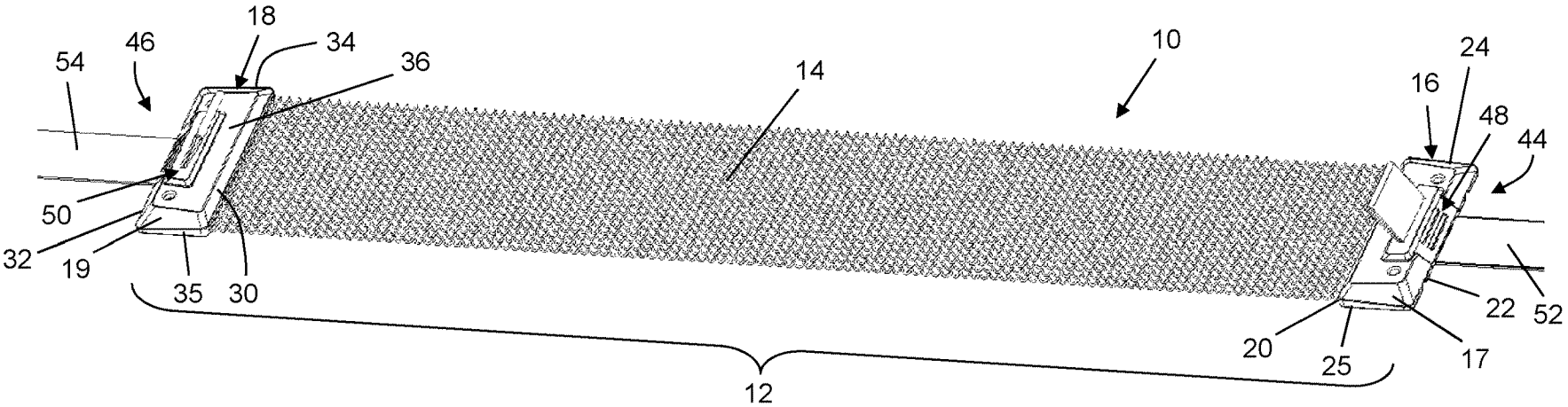
FIG. 1 is a perspective view of an embodiment of the disclosed rapid connect snare system.
Figure 2:
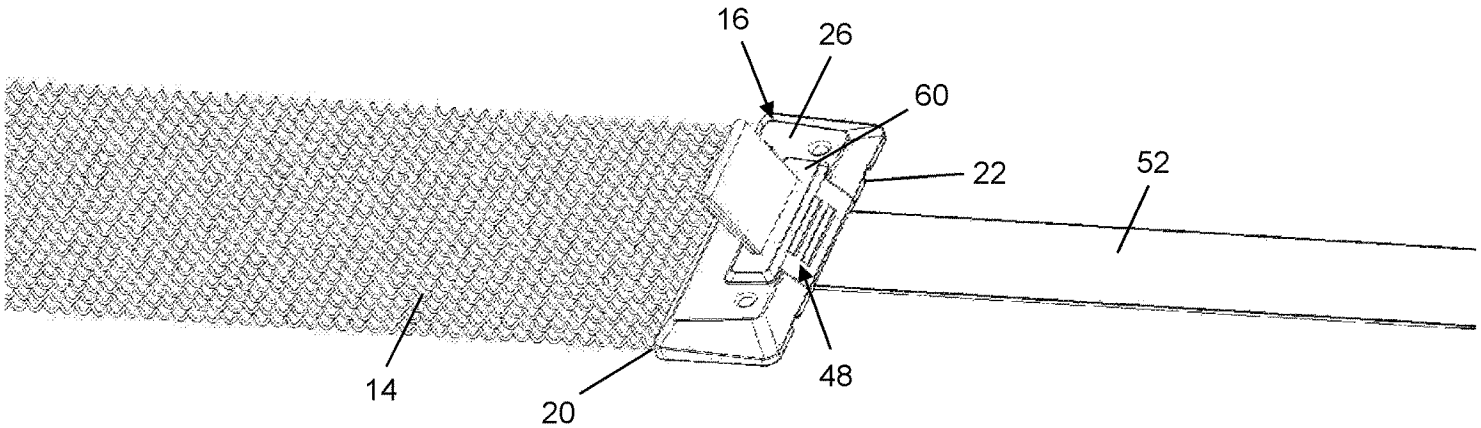
FIG. 2 is an enlarged view of one longitudinal end of the snare system of FIG. 1.
Figure 3:
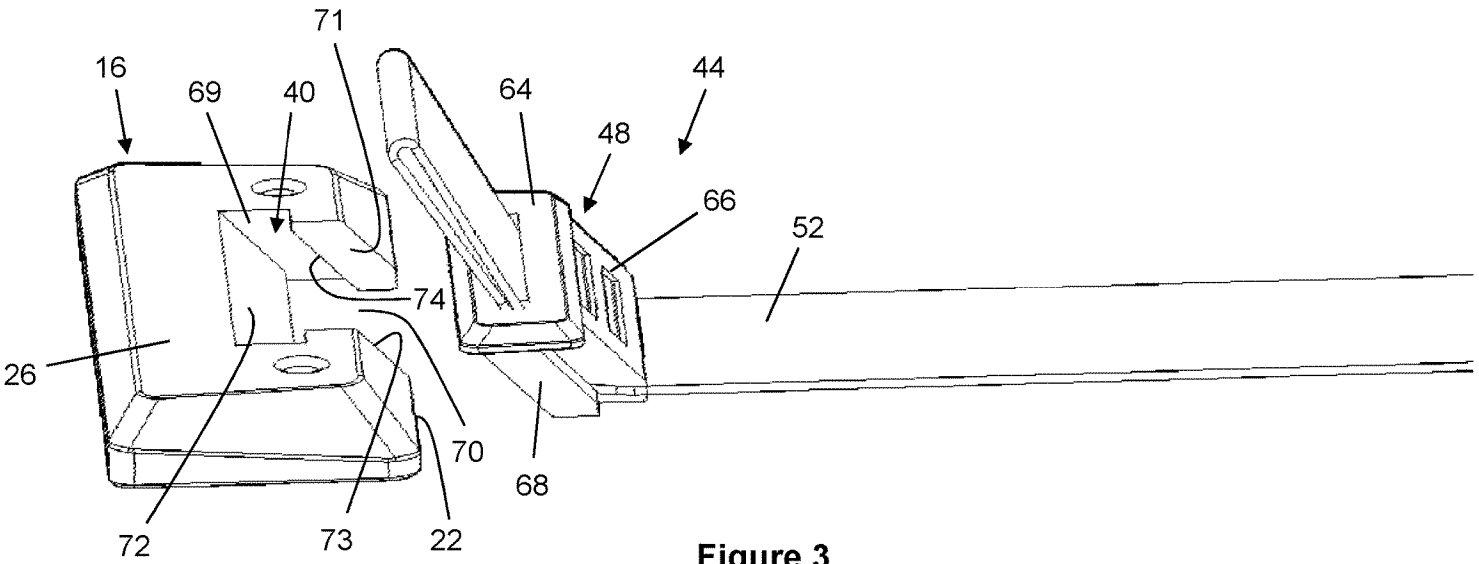
FIG. 3 shows a connector and end plate from the disclosed snare system disengaged and with snares removed.
Figure 4:
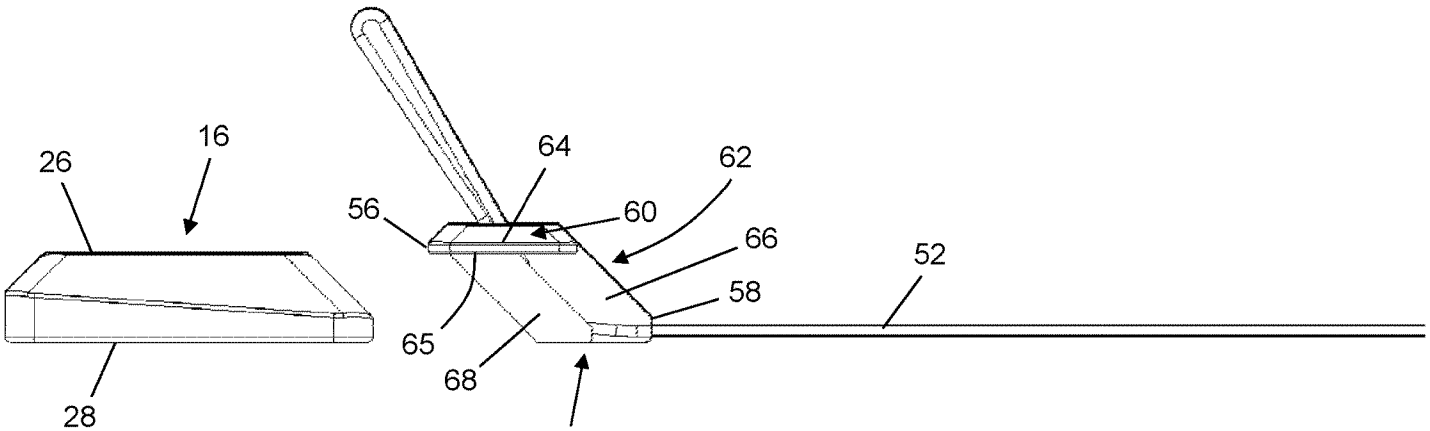
FIG. 4 is a side elevation view of the connector and end plate of FIG. 3.
Figure 5:
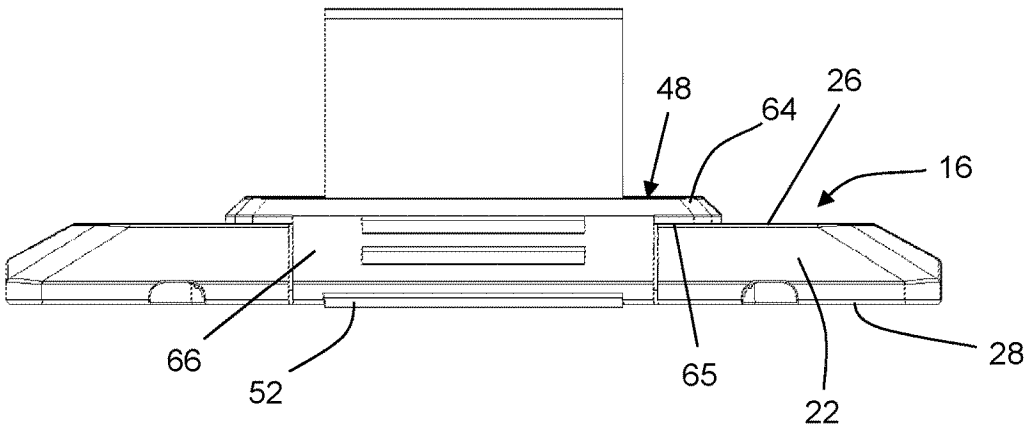
FIG. 5 is a longitudinal end elevation view of the snare system of FIG. 1.
Figure 6:
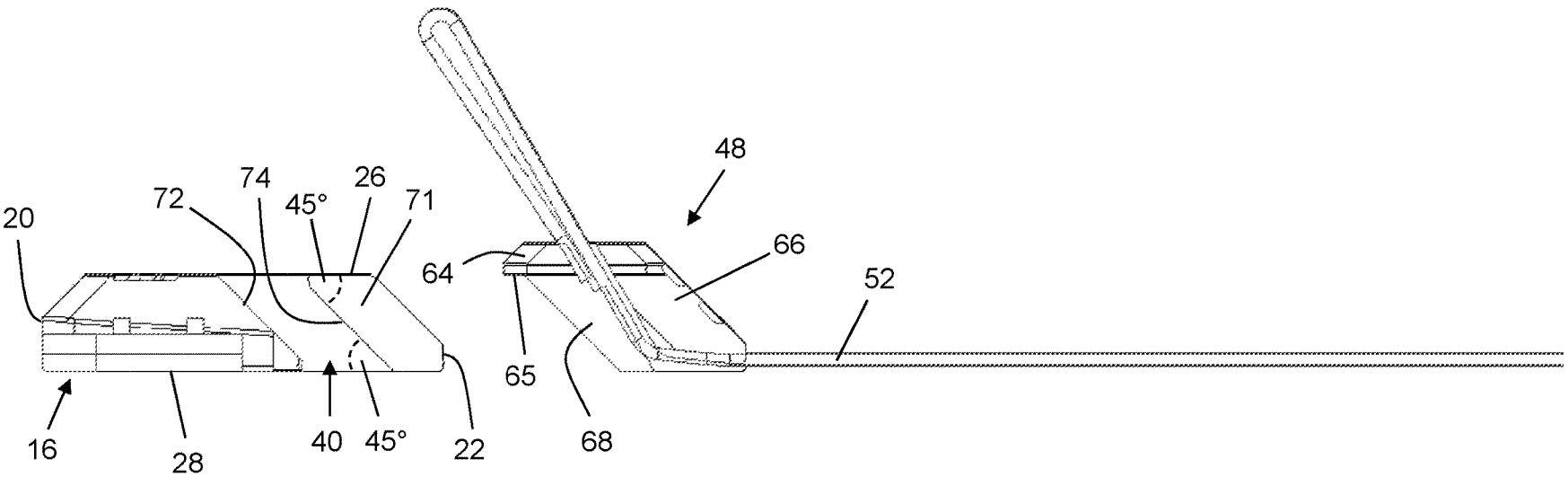
FIG. 6 shows the connector and end plate of FIG. 3 in a cross-sectional view.

FIG. 1 shows a first embodiment of the disclosed snare system 10. The snare system 10 most generally includes a snare assembly 12 with a plurality of elongate snare wires 14 extending longitudinally between opposite ends. Each opposite end carries an end plate, 16 and 18, that is attachable to a connector with a strap.

Figure 8:
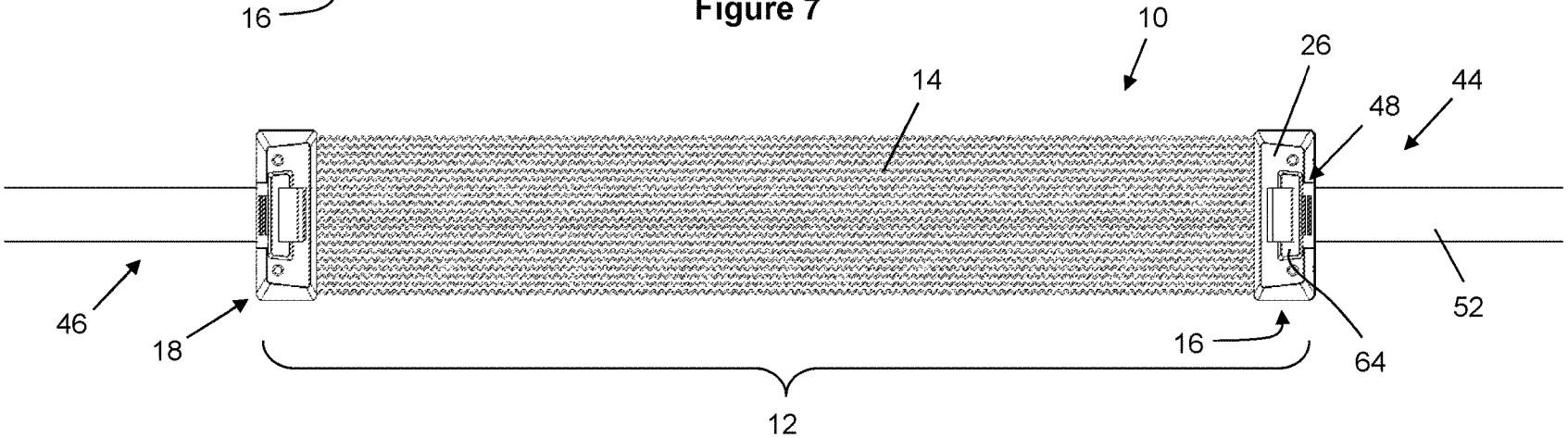
FIG. 8 is a top elevation view of the snare system of FIG. 1.

The first end plate 16 extends longitudinally from an inner edge 20 to an outer edge 22, and laterally between opposite lateral edges, 24 and 25. The first end plate defines a top side 26 and a bottom (drumhead) side 28, each being substantially flat or at least including a significant substantially flat portion. The designations "top", "bottom", "upper" and "lower" are given relative to the views in FIGS. 1-6 and 14-16. Notably, these designations are opposite when the snare system 10 is attached to a drum in position for playing, underneath the bottom drumhead with the "bottom" portions of the end plates and latch members facing upwards toward the drumhead. As shown in FIGS. 1 and 8, the snares 14 are attached to the first end plate 16 and extend longitudinally from the inner edge 20 to their respective opposite ends which are attached to the second end plate 18 ("inner" and "outer" designations are used in reference to the respective elements' usual positioning on a drumhead). Each end plate includes a body that defines a slot 40 extending therethrough.

Figure 7:
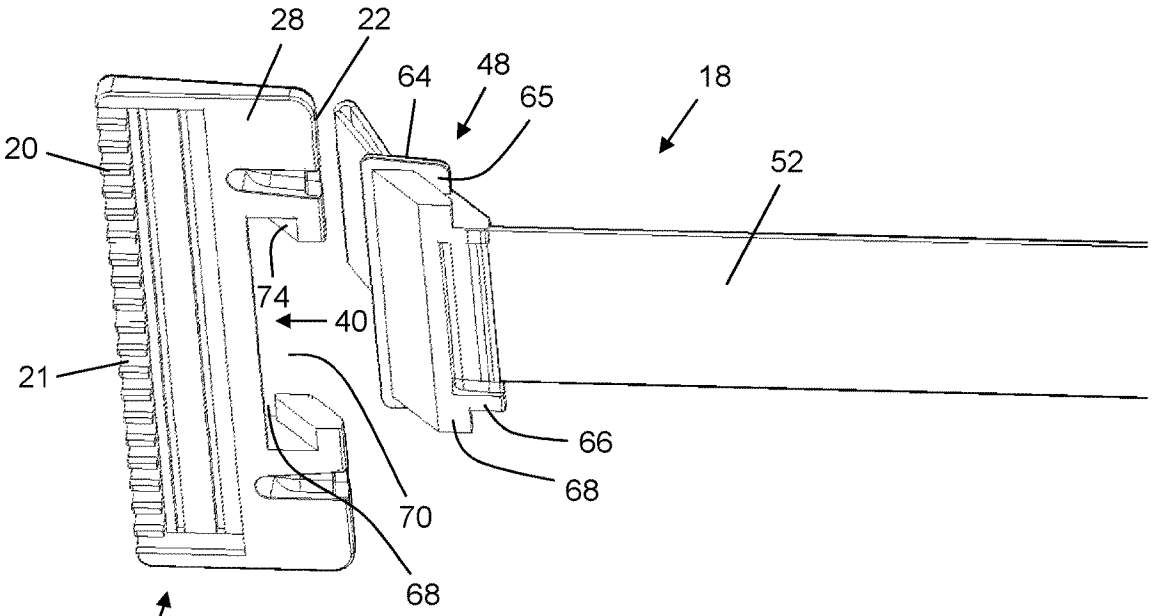
FIG. 7 is a bottom perspective view of the connector and end plate of FIG. 3.

The second end plate 18 is preferably substantially identical to the first end plate 16, and extends longitudinally from an inner edge 30 to an outer edge 32, and laterally between opposite lateral edge, 34 and 35. The second end plate also defines a top side 36 and bottom (drumhead) side (not shown), each of which is substantially flat or has a significant substantially flat portion. The snares 14 extend from their first ends attached to the first end plate 16 to their second ends that are attached to the second end plate 18. In a preferred embodiment, the end plates are formed of a polymer material and are secured to the snare wires 14 via a molding process, such as for example injection molding. Other manufacturing techniques can be employed to securely attach the snares to the end plates, such as adhesives which may be epoxy-based, or a mechanical attachment. As shown in the bottom view of FIG. 7, each of the snares 14 can be received in a snare receptacle 21 formed in the inner edge 20 of the end plate 16.

The snare system 10 further includes a first connector 44 on one longitudinal side and a second connector 46 on the opposite longitudinal side. Each connector includes a latch member, 48 and 50, that carries a strap, 52 and 54, extending longitudinally therefrom. The first latch member 48 and second latch member 50 are substantially identical and will be described further with reference to the first latch member 48. As shown most clearly in FIGS. 3-7, 14 and 15, the first latch member 48 includes a body with an inner edge 56 and an outer edge 58. The body of the latch member 48 has a diagonally sloped side profile, as shown clearly in FIGS. 3-6, such that the inner edge 56 is positioned on a top level 60 while the outer edge 58 is positioned on a lower level 62. The top level 60 defines a shoulder 64 with a substantially flat bottom surface 65. The lower level 62 extends downward from the top level 60 at an oblique angle relative to the flat bottom surface 65 and terminates at the outer edge 58.

The lower level 62 defines a laterally central web section 66 and a flange 68. The flange 68 extends laterally outward from the web section 66 at a longitudinally inward position of the lower level 62. As will be discussed in detail below, the flange 68 is configured for slidable receipt by the slot 40 in the first end plate 16, which has a cooperative obliquely angled contour to provide advantageous leverage on the snares 14 when engaged.

As noted above, the second connector 46 is preferably substantially identical to the first connector 44. Thus, the individual elements of the second connector or its latch member will not be repeated in detail herein.

The first and second end plates, 16 and 18, each defines a slot extending through its body from its respective top surface to its respective bottom surface. Like the first and second connectors, 44 and 46, the first and second end plates, 16 and 18, are preferably substantially identical to one another and will be described in detail with reference to the first end plate 16. The top surface 26 of the body of the first end plate 16 is substantially flat and can be said to be substantially parallel to the longitudinal direction defined by the direction of extension of the snares 14 across the drumhead when attached and pulled taut. The slot 40 is positioned laterally intermediate the opposite lateral edges 24 and 25, and includes a portion that extends longitudinally through the outer edge 22. Generally, the slot 40 has a T-shape from a top view with a size, shape and oblique configuration to correspond closely with the size, shape and oblique configuration of the lower level 62 of the latch member 48. Specifically, the slot 40 includes a laterally wide section 69 and a laterally narrow section 70 with the narrow section 70 extending through the outer edge 22 of the body of the first end plate 16. The wide section 69 of the slot is defined between longitudinally opposing surfaces, 72 and 74, which are flat and angled obliquely relative to the top surface 26 of the end plate 16 and preferably parallel to one another. The oblique angle of the wide section of the slot is preferably the same as that of the flange 68 in the latch member 48 so that the surfaces of the flange are slidably received tightly between the respective surfaces, 72 and 74, of the slot 40 with the latch member web 66 extending longitudinally through the narrow section 70 of the slot 40.

In the embodiment of the snare system 10 of FIGS. 1-8, the connector 44 includes a tab 76 that extends from the top of the latch member 48 which can be used to disengage the latch member 48 from the end plate 16 by pulling the flange 68 upward and out from the slot 40. In the depicted embodiment, the tab 76 is formed from the same material as the strap 52 and extends through the body of the latch member 48 and out from the top.

Figure 9:
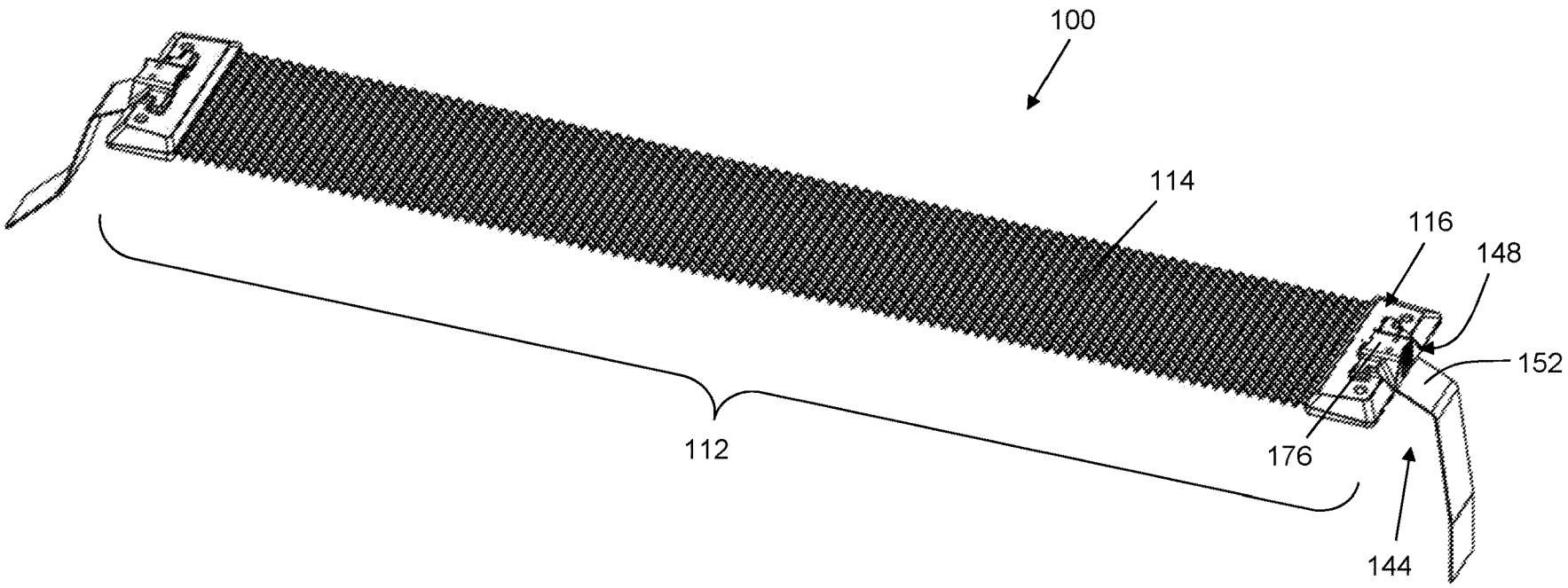
FIG. 9 is a top perspective view of a second embodiment of the disclosed snare system.
Figure 10:
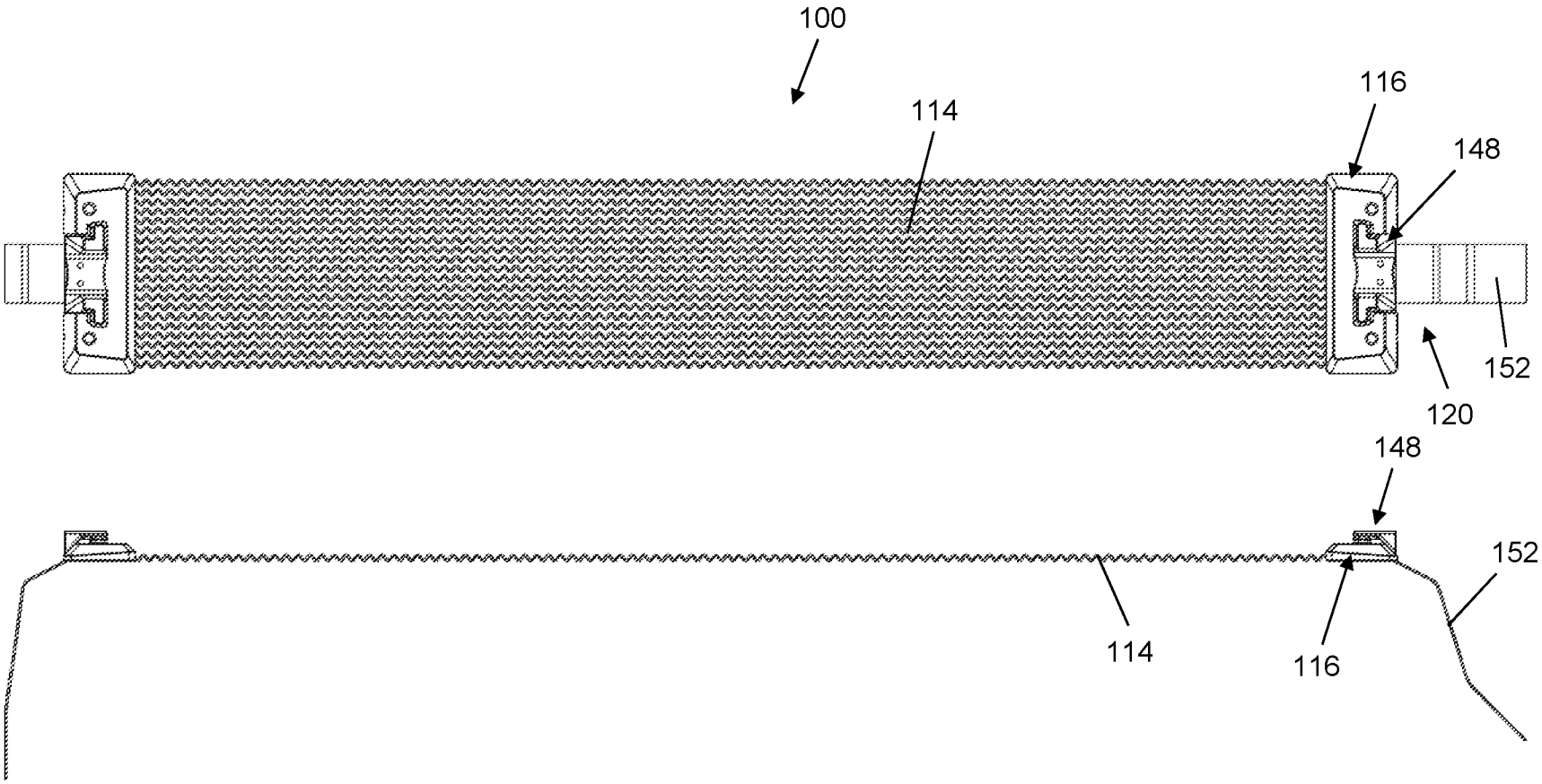
FIG. 10 shows top and side elevation views of the snare system of FIG. 9.
Figure 11:
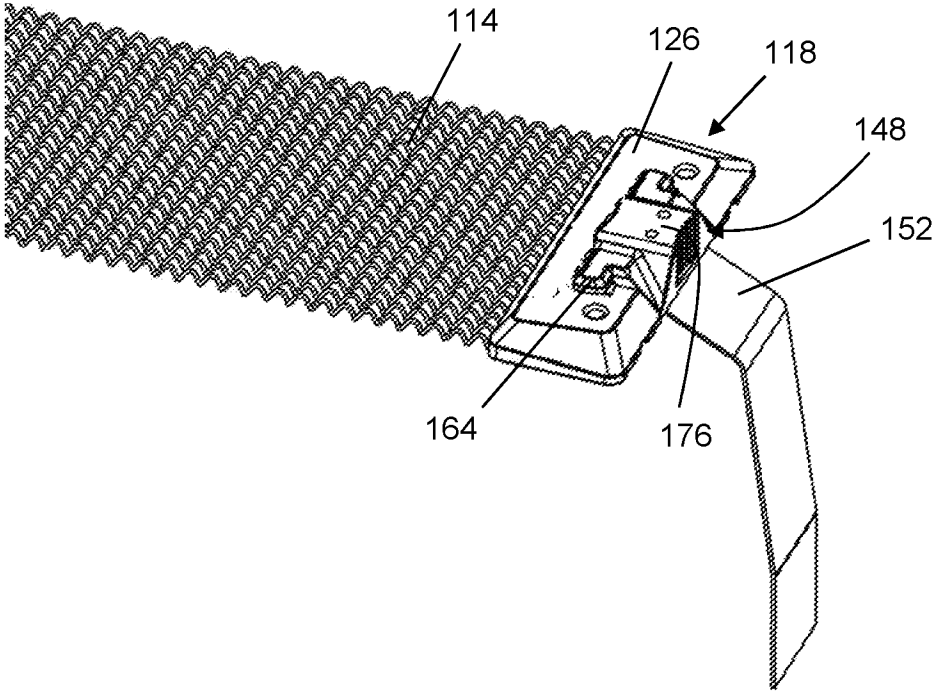
FIG. 11 is an enlarged view of one longitudinal end of the snare system of FIG. 10.
Figure 12:
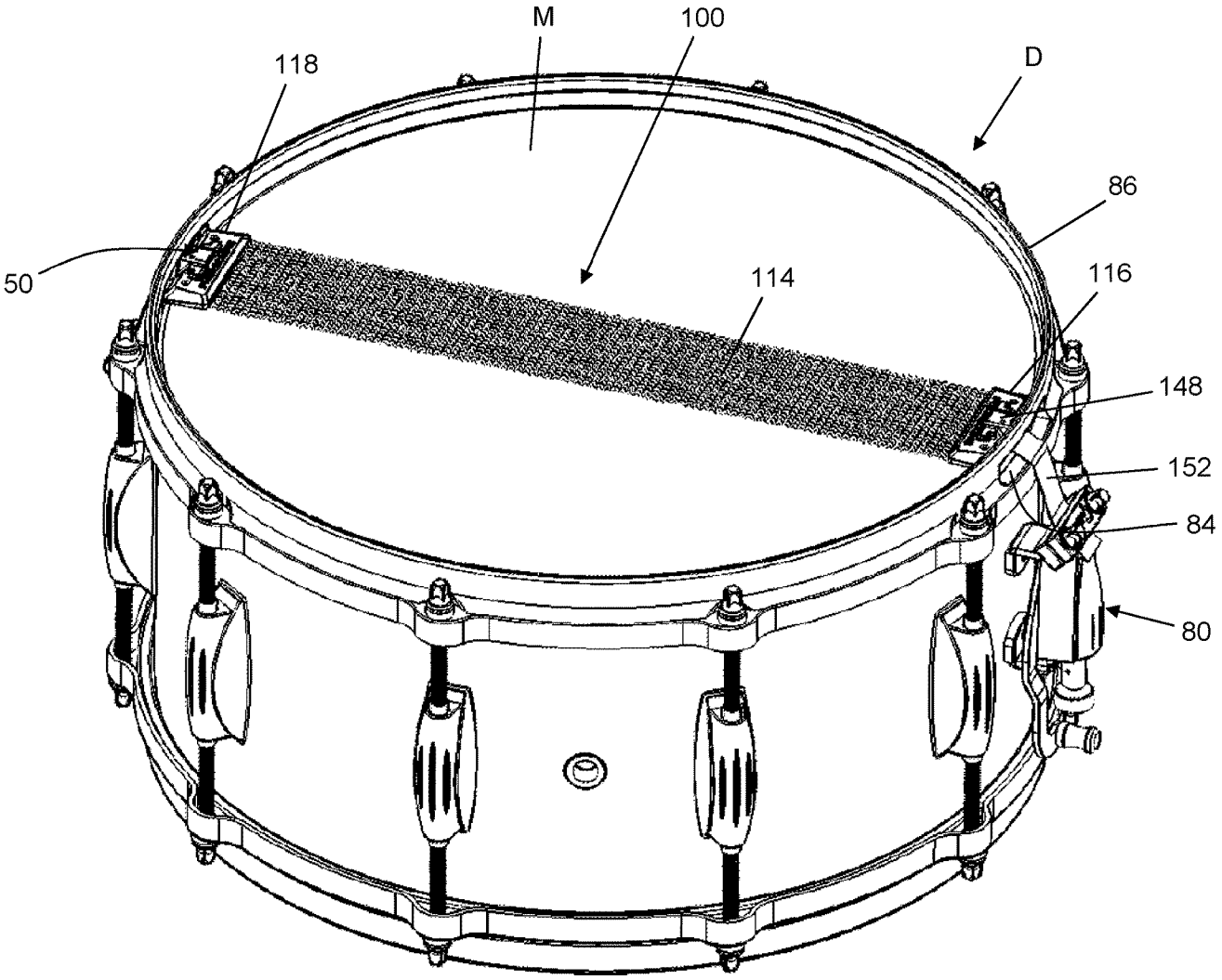
FIG. 12 is a representation of the snare system of FIG. 10 attached to a snare drum at the bottom drumhead.
Figure 13:
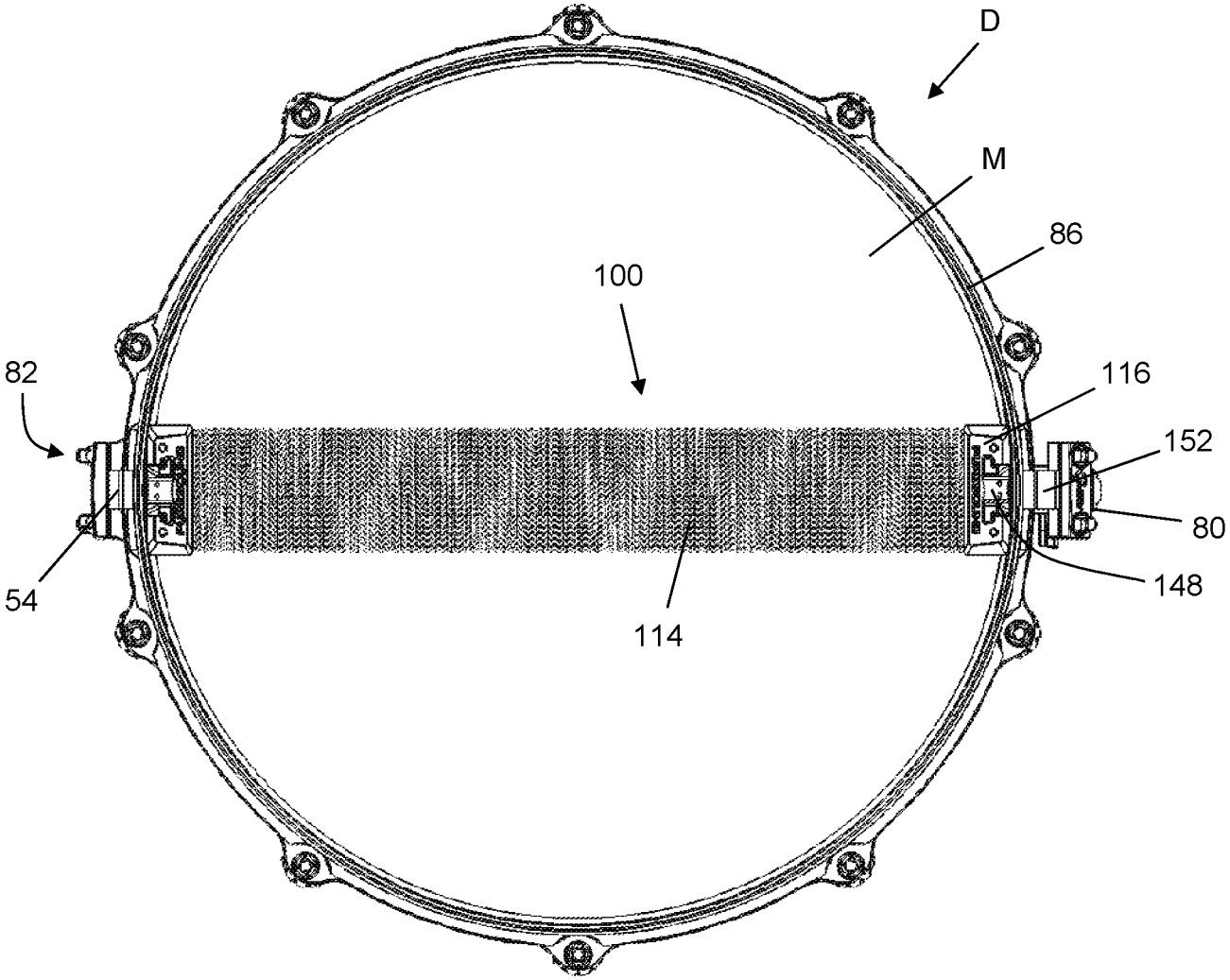
FIG. 13 is an elevation view of the snare system attached to the drum of FIG. 12.
Figure 14:
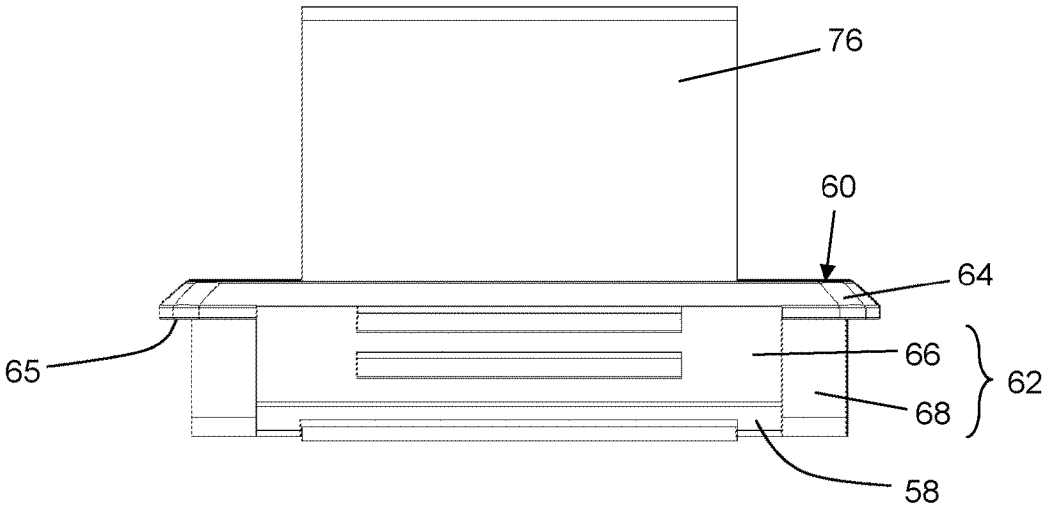
FIG. 14 is an longitudinal end elevation view of the connector for use within the snare system of FIG. 1.
Figure 15:
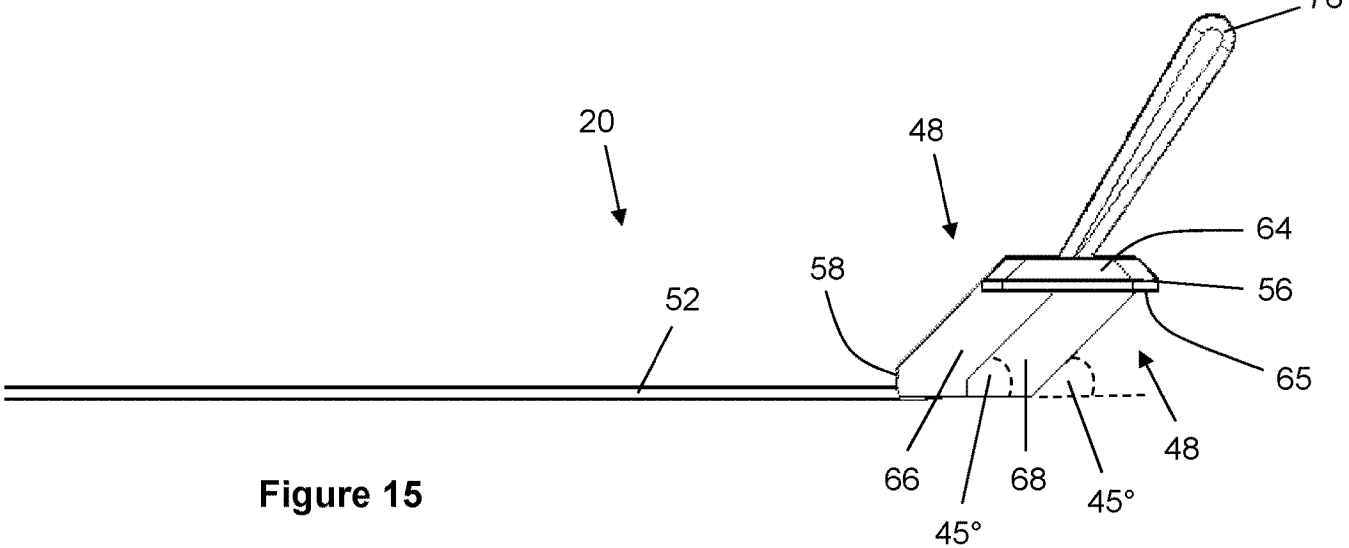
FIG. 15 is a side elevation view of the connector of FIG. 14.
Figure 16:
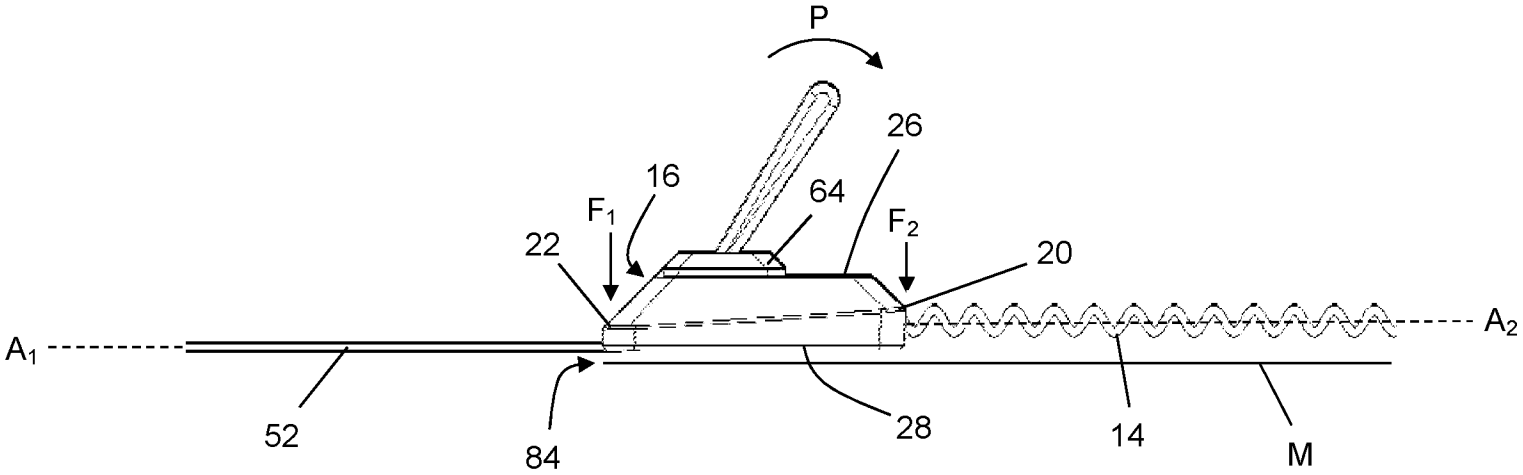
FIG. 16 is a side elevation view of a connector, end plate and snares showing the force vectors in an attachment of the snare system to a snare drum.
Figure 17:
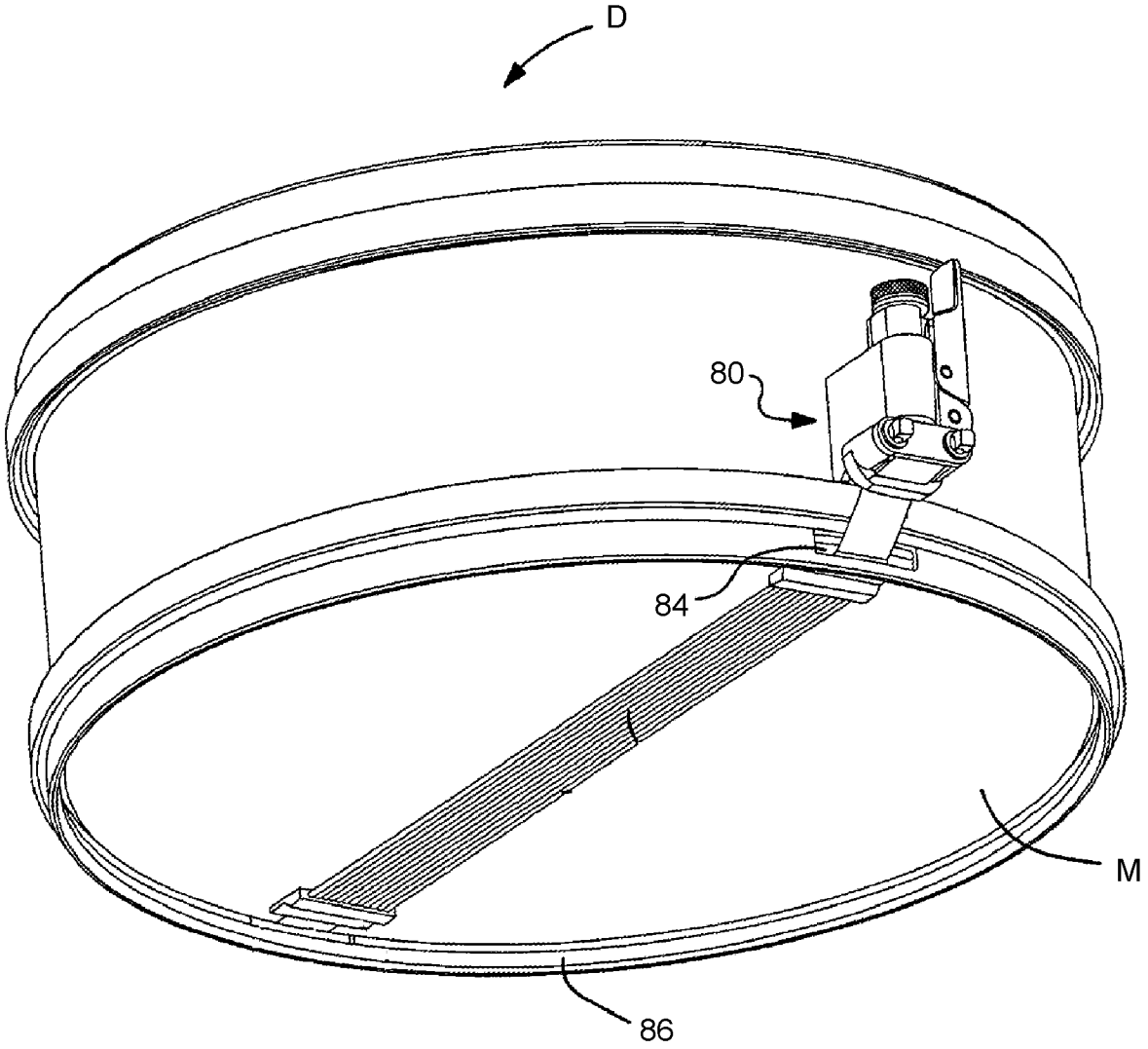
FIG. 17 shows a representation of a snare drum.

FIGS. 9-11 depict another embodiment of the snare system 100. In this embodiment, the snare assembly 112 is substantially identical to that of the earlier embodiment identified with reference numeral 12. The connectors 144 diverge moderately from the connectors 44 in the earlier embodiment in that the tab 76 is omitted from the latch member 148 in favor of an elevated outer body portion 176 that provides a leveraging surface or surfaces for a user to grip and disengage the latch member 148 from the end plate 116.

The elements and sub-elements that are common between the embodiment of the snare system 100 of FIGS. 9-11 and the embodiment of the snare system 10 of FIGS. 1-8 are identified with reference numerals having identical last two digits; reference numerals of the respective elements of the system 100 include a preceding "1". The common elements and their relationships and interactions within the snare system 100 are substantially identical to those in the snare system 10, and thus can readily be understood by one skilled in the art with reference to FIGS. 1-8 and corresponding description.

In a typical attachment of the snare system 10 to a drum, the first connector 44 is attached to a snare strainer 80 with the second connector 46 attached to the butt unit 82 via the respective straps, 52 and 54, as known in the art. The straps 52 and 54 extend through respective snare beds 84 with the latch members 48 and 50 positioned inward of the drum rim or bearing edge 86 and the lower level 62 of the latch members facing the drumhead membrane M and the top level 60 facing away from the drumhead. The snare assembly 12 is thereafter attached via sliding engagement between the oblique flanges 68 of the latch members with the complimentary wide section 69 of the oblique slots 40 in the end plates 16 and 18. When engaged, the web section 66 extends through the narrow section 70 of the slot tightly between the opposing lateral shoulders 71 and 73 defining the narrow section. The configuration of the flanges 68 in the latch members 48 and 50, extending obliquely downward and outward from the longitudinally inner portion of the top level 60 carries numerous mechanical benefits. When the snare drum D is inverted so that the snare system 10 and bottom drumhead are underneath (i.e., in the normal playing position of a snare drum), the flanges extend upward and outward to maintain the end plates vertically with the shoulder 64 supporting the end plate 16. Additionally, upon tightening of the strainer 80, the engagement of the oblique flange acts as a hook in the slot to pull the snare wires 14 taut into contact with the bottom drumhead membrane M. Moreover, the tight surface-to-surface abutment between the flange 68 with surfaces 72 and 74, and surface-to-surface contact between the web 68 and the surfaces of the narrow section 70 provide enhanced stability and rigidity to the structure in all directions compared with known snare attachment systems with hooks or other clips.

As referenced above, the relative height positioning of the longitudinal axis $A_1$ of the strap 52 and longitudinal axis $A_2$ of the taut snare wires 14 when the connector and snare assembly are attached carries another significant benefit to the snare system 10. With reference to the representative drawing in FIG. 16, it can be seen that the strap axis $A_1$ is lower (in the depiction of FIG. 16) than the central axis $A_2$ of the taut snare wires 14 when the end plate 16 is attached to the latch member 48 (note that the strap axis $A_1$ is higher than the central axis $A_2$ when attached underneath the lower drumhead membrane M in a typical playing position). When the snare assembly 12 is attached to the drum via engagement of the end plates to the latch members and the strap 52 is tightened by the strainer, the outer edge 22 of the end plate 16 experiences a downward force $F_1$ caused by the strap 52 pulling around a slight depression in the edge of the drum shell at the snare bed 84. The first force $F_1$ acts to hold the outer edge 22 of the end plate against the drumhead membrane M. Since the snare axis $A_2$ is higher than the strap axis $A_1$, the pull of the snare wires 14 causes a second downward force F2 on the inner edge 20 of the end plate 16, which acts to pivot (P) the inner edge down against the drumhead membrane M. The second force $F_2$, created by the differential height between the strap axis $A_1$ and snare axis $A_2$, is less than the first force $F_1$, resulting in the end plate 16 lying flat against the membrane M without clearance therebetween. Pressing of the inner edge 20 into the drumhead membrane M so the end plate 16 lies flat reduces undesired slack at ends of the snares 14 and clearance between the snares and drumhead membrane M, which reduces or even eliminates sympathetic vibration that causes undesirable snare buzz. This is accomplished in the disclosed embodiments by the relative positioning of the strap 52 with its longitudinal axis $A_1$ lower than the central axis $A_2$ of the taut snare wires 14 when the end plate 16 is attached to the latch member 48. It is advantageous to position the strap in as low of a position as possible on the latch member 48.

The embodiments of the disclosed snare assembly, 10 and 100, allow rapid removal of a first snare assembly 12 and replacement with another snare assembly having different tonal characteristics simply by disengaging the latch members 48 and 50 from the end plates 16 and 18 in the first snare assembly and attaching the end plates of the second snare assembly to the latch members via the same sliding oblique flange engagement. The respective straps 52 and 54 remain directly attached to the butt unit 82 and strainer 80 with the latch members in position within the rim 86 of the drum D, so the cumbersome and time-consuming process of changing out snares as known in the art is avoided. Once the straps 52 are attached to the butt end and strainer, changing out a snare assembly with the disclosed system 10 and 100 can be accomplished in a matter of seconds, as opposed to several minutes with systems as known in the current state of the art.

In the depicted preferred embodiments, the end plates 16 and 18, and latch members 48 and 50 are formed of a molded polymer material. The snares may be of a variety of materials, including metal (steel), gut or nylon and of different gauges or configurations. The oblique angle at which the front and rear surfaces 69 and 70 of the slot lie relative to the flat top surface and/or longitudinal axis is preferably within an approximate range of 30°-60°, more preferably within an approximate range of 40°-50°. In the depicted preferred embodiment, the oblique angle is approximately 45°. The flange 68 and its front and rear surfaces preferably extend at the same oblique angle as the slot surfaces to ensure a tight surface-to-surface relationship when engaged. Such a tight fit provides enhanced stability and rigid connectivity between the connector and snare assembly, while retaining the facile sliding attachment and detachment capabilities.

This invention has been shown and described with respect to the detailed embodiments thereof, however, it will be understood by those skilled in the art that various changes in from and detail thereof may be made without departing from the spirit and the inventive scope.

What is claimed is:

1. A snare system for use with a drum, comprising:

a snare assembly having a plurality of snares extending longitudinally between opposite ends, the snares being attached at a first end to an end plate with a body that defines a slot between two longitudinally opposed flat surfaces, the end plate further defining a longitudinally inner edge and a longitudinally outer edge;

a connector with a strap that carries a latch member, the strap extending longitudinally from an outer edge of the latch member being configured to attach to the drum at an outer portion thereof, and the latch member including a flange with two longitudinally opposed flat surfaces, each longitudinally opposed flat surface extending at an oblique angle relative to the longitudinal direction configured for sliding receipt within the slot of the end plate, wherein the longitudinally opposed flat surfaces of the slot are angled relative to the longitudinal direction at the same oblique angle as the longitudinally opposed flat surfaces of the flange such that each flat surface of the flange abuts one of the opposed flat surfaces of the slot in a surface-to-surface contact when the flange is slidingly received within the slot.

2. The snare system of claim 1, wherein the latch member includes a top shoulder from which the flange extends at an oblique angle, the shoulder being configured to abut a top surface of the body of the end plate when the flange is received within the slot.

3. The snare system of claim 1, wherein the slot in the end plate is closed on a longitudinally inner side and opened on a longitudinally outer side, extending through the outer edge of the body.

4. The snare system of claim 3, wherein the slot includes a laterally wide section at a longitudinally inner position and a laterally narrow section at a longitudinally outer position that extends through the outer edge of the body.

5. The snare system of claim 1, wherein the engagement of the flange and the slot causes the end plate to pivot with the inner edge biased toward the drumhead such that the end plate lies substantially flat on the drumhead when the connector is engaged with the snare assembly via the flange in the slot.

6. A snare system for use with a drum, comprising:

a snare assembly having a plurality of snares extending longitudinally between opposite ends, the snares being attached at a first end to an end plate with a body that defines a slot between two longitudinally opposed flat surfaces, the end plate further defining a longitudinally inner edge and a longitudinally outer edge;

a connector with a strap that carries a latch member, the strap extending longitudinally from an outer edge of the latch member being configured to attach to the drum at an outer portion thereof, and the latch member including a flange configured for sliding receipt within the slot of the end plate, wherein each of the slot and the flange is angled obliquely relative to the longitudinal direction such that the latch member abuts both of the opposed flat surfaces in a surface-to-surface configuration when slidingly received within the slot, and the latch member defines a top side and a substantially flat bottom side configured to face the drum membrane when attached to the drum and snare assembly with the flange received within the slot.

7. The snare system of claim 6, wherein the connector strap extends longitudinally from the edge of the connector at a position proximate the bottom side of the connector.

8. The snare system of claim 6, wherein the end plate defines a substantially flat bottom side configured to face the drum membrane when the snare assembly is attached to the drum.

9. The snare system of claim 6, wherein the snare assembly includes a second end plate attached to the second longitudinal end of the plurality of snares, the second end plate having a body that defines a slot that extends obliquely relative to the longitudinal direction and in an opposite relative direction from the slot in the first end plate.

10. The snare system of claim 6, wherein the flange extends obliquely relative to the longitudinal direction within an approximate angular range of 30°-60°, and the longitudinally opposed flat surfaces of the slot extend at the same angle.

11. The snare system of claim 10, wherein the approximate angular range at which the flange extends is 40°-50°.

12. The snare system of claim 6, wherein the latch member includes a top shoulder from which the flange extends at an oblique angle, the shoulder being configured to abut a top surface of the body of the end plate when the flange is received within the slot.

13. The snare system of claim 6, wherein the slot in the end plate is closed on a longitudinally inner side and opened on a longitudinally outer side, extending through the outer edge of the body.

14. The snare system of claim 6, wherein the engagement of the flange and the slot causes the end plate to pivot with the inner edge biased toward the drumhead such that the end plate lies substantially flat on the drumhead when the connector is engaged with the snare assembly via the flange in the slot.

15. A removable snare system for use with a drum, comprising:

a snare assembly with a plurality of elongate snares extending substantially parallel to one another longitudinally between opposing ends, one end of the snares being attached to a first end plate with a substantially flat top surface and a bottom surface, an inner edge and an opposite outer edge, the end plate further defining a slot extending between the top and bottom surfaces;

a first connector comprising a strap extending from an outer edge of a latch member, the strap being connectable to a side of a drum, the latch member including a flange slidably receivable within the slot of the end plate, wherein the slot includes a longitudinally forward surface and a longitudinally rearward surface, each slot surface extending obliquely downward relative to the flat top surface and being engaged by an opposite surface of the flange in a surface-to-surface engagement, thereby rigidly securing the latch member to the end plate when the flange is received within the slot, and the latch member includes a top level comprising a shoulder that extends laterally beyond the flange, the shoulder abutting the top surface of the end plate when the flange is received within the slot.

16. The removable snare system of claim 15, wherein the slot surfaces extend obliquely downward and outward from the top surface toward the bottom surface.

17. The removable snare system of claim 16, wherein the latch member includes a top level comprising a shoulder that extends laterally beyond the flange, the shoulder abutting the top surface of the end plate when the flange is received within the slot, and wherein the flange extends obliquely downward and outward from the shoulder.

18. The removable snare system of claim 15, wherein the flange extends obliquely downward and outward from the shoulder.

19. The removable snare system of claim 15, wherein the longitudinally forward surface and a longitudinally rearward surface of the slot extend obliquely relative to the flat top surface within an approximate angular range of 30°-60°, and the flange extends at the same angle.

20. The removable snare system of claim 19, wherein the approximate angular range at which the longitudinally forward surface and longitudinally rearward surface extend is 40°-50°.

* * * * *